US005222302A

United States Patent [19]

DeBatty et al.

[11] Patent Number: 5,222,302

[45] Date of Patent: Jun. 29, 1993

[54] FIREARM SIGHTS ALIGNER

[76] Inventors: W. Marion DeBatty, 401 S. Seas Dr. #501, Jupiter, Fla. 33477; H. Bradley Ganther, 4777 Square Lake Dr., Lake Park, Fla. 33418

[21] Appl. No.: 698,570

[22] Filed: May 10, 1991

[51] Int. Cl.[5] ..... F41G 3/00

[52] U.S. Cl. ..... 33/233; 33/234

[58] Field of Search ..... 33/227, 233, 234, 241, 33/246, 248, 252, 286, 297, 298; 356/138, 153

[56] References Cited

U.S. PATENT DOCUMENTS

| | | | |
|---|---|---|---|
| 3,711,204 | 1/1973 | Steck | 356/138 |
| 3,744,133 | 7/1973 | Fukushima et al. | 33/244 |
| 4,534,116 | 8/1985 | Davis | 33/234 |
| 4,554,745 | 11/1985 | Repa | 33/248 |

FOREIGN PATENT DOCUMENTS

| | | | |
|---|---|---|---|
| 2194621 | 3/1988 | United Kingdom | 33/233 |

OTHER PUBLICATIONS

"Ken's Gun Room" Catalog. p. 316, Summer 1991.

*Primary Examiner*—William A. Cuchlinski, Jr.
*Assistant Examiner*—Alvin Wirthlin
*Attorney, Agent, or Firm*—Lane & Mittendorf

[57] ABSTRACT

A firearm sights aligner for mounting in the bore of a firearm includes a collimator arrangement having a defuser, a sighting grid, and an objective lens. The sighting grid is mounted in the collimator arrangement so that its position can be adjusted in azimuth and elevation in response to movement of exterior mounted adjusting screw mechanisms. The adjusting screw mechanisms each include a multi-start threaded screw in order to enable full translation of the grid over its full range of azimuth and elevation in one 360° revolution of each of the adjusting screw mechanisms.

5 Claims, 3 Drawing Sheets

QUICK-CLIK™ RECORDING CARD

SERIAL _____ DATE RECORDED _____

NAME OF RECORDER _____

31

| WEAPON TYPE | ADAPTER HOLE POSITION | ELEVATION SETTING | AZIMUTH SETTING |
|---|---|---|---|
| M16A2, 5.56 | C | | |
| M16A1, 5.56 | C | | |
| SAW-M249, 5.56 | B | | |
| M60, 7.62 | D | | |
| M2, 50 | D | | |
| | | | |
| | | | |

FIREARM SIGHTS ALIGNER

TECHNICAL FIELD

The present invention relates generally to a device and method for aligning sights on firearms, and more specifically to a device and method for aligning sights on multiple firearms using sight alignment from a first firearm that has been sighted-in as a master. Further, a record of the sight alignment for the master firearm can be used with the present invention at any time to realign sights on the master or other firearms.

BACKGROUND ART

Various apparatus and methods have previously been devised for aligning sights on firearms. U.S. Pat. No. 3,744,133 to Fukushima, et al., for example, describes a collimating device having a bore support member and an upstanding member with a sighting grid for adjusting telescopic sights on firearms. One variation of the disclosed apparatus includes fitting a light reducing member at the front, i.e. objective lens, of the telescopic sight to be aligned. The disclosed method for using the device is to adjust the alignment of the optic axis of a telescopic sight so it is parallel to that of the bore of the firearm on which the telescopic sight is mounted. There is no provision for adjusting alignment of the collimating device after sighting in a firearm by firing ammunition to compensate for misalignment between projectile trajectory and the axis of the bore so the collimating device can be retained as a master for that firearm and others of its type, i.e. caliber and action-type. Further this collimating device is only disclosed for alignment of telescopic sights, neither open or aperture iron sights are considered.

Variations of collimating devices to that disclosed in U.S. Pat. No. 3,744,133 include use of an objective lens mounted on a tube also mounting a sighting grid. The objective lens is fixed at its focal length from the sighting grid. This collimator tube arrangement is again mounted to a firearm using a bore support member, so the collimator optic axis is parallel to the firearm bore axis. But as with the collimating device disclosed in U.S. Pat. No. 3,744,133 there is no provision for adjusting alignment of the sight grid in the collimator, and therefore the optic axis, after sighting in a firearm to compensate for misalignment between projectile trajectory and the axis of the bore so the collimator can be retained as a master for that firearm and others of its type, i.e. caliber and action-type.

Still another variation of known firearm sight alignment collimating devices includes an objective lens with sighting grid collimator arrangement intended to be mounted on a bore support member. For this device, alignment of the sighting grid is adjustable. The intended use is for alignment of military firearms. A weapon of one type, i.e. caliber and action-type, is first sighted in by firing ammunition at a target. Then the bore support member is positioned in the firearm bore so the collimator objective lens is in line with the sights. Next the sighting grid position is adjusted to align the collimator optic axis with the optic axis of the sights on the firearm. After having aligned the sighting grid, the collimator arrangement with bore support member is mounted on other firearms of the same type and sights on these firearms are aligned with the optic axis of the collimator arrangement. Sights on other firearms types can similarly be aligned. However, one firearm of each type must be preserved as a master or the entire process must be repeated to include sighting in with live ammunition. Accordingly, this known collimator device and method requires maintaining master firearms such that sights are not misaligned.

DISCLOSURE OF INVENTION

The intended use of the present invention is for rugged military applications and associated severe environmental conditions. However, the present invention is not limited to these applications alone and is also applicable to civilian firearm applications to include both firearms equipped with telescopic and open or aperture iron sights. Additionally the present invention is applicable to use on firearm types other than rifles and machine guns such as pistols. In military type applications the present invention can also be used to align night vision sighting devices.

The present invention includes a collimator arrangement having a defuser, a sighting grid, and an objective lens. The sighting grid is mounted in the collimator arrangement so its position can be adjusted in response to movement of exterior mounted screw arrangements. Two adjusting screw arrangements are specifically provided on the collimator so both the azimuth and elevation positions of the sighting grid can be adjusted. Each of the adjusting screw arrangements provides for a single 360° turn. Accordingly, full movement in both azimuth and elevation directions of the sighting grid is provided by one 360° turn of the respective adjusting screw arrangements. Such single revolution movements of the adjusting screw arrangements provides for calibrated positioning of the sighting grid. By recording the angular position of the adjusting screw arrangements for both elevation and azimuth, the sighting grid can be repositioned for a particular firearm type, and accordingly a master firearm does not have to be set aside to preserve sight alignment so firearms of that type can be realigned at a later date.

An objective of the present invention is to provide a firearm sights aligner which can be used to align firearm sights in reduced time from that previously required.

Another object of the present invention is to provide a firearm sights aligner that is less expensive, more rugged and more accurate than prior known devices.

Still another object of the present invention is to provide a firearm sights aligner that can be used for reconfirming sight alignment on firearms without firing live ammunition or preserving a master firearm with aligned sights.

BRIEF DESCRIPTION OF THE DRAWINGS

The various objects, advantages and novel features of the present inventor will become more readily apprehended from the following detailed description when taken in conjunction with the appended drawings, in which.

BEST MODE FOR CARRYING OUT THE INVENTION

Figure 1:
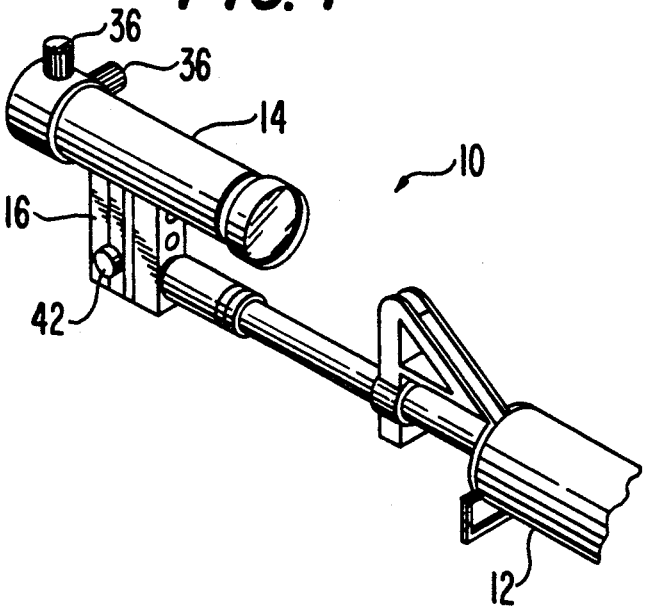
FIG. 1 is a perspective view of a sights aligner device according to the present invention mounted from a firearm barrel.

Referring now to the drawings, wherein corresponding components are designated by the same reference numerals throughout the various figures. A firearm sights aligner device according to the present invention is illustrated in FIG. 1 where it is generally designated by reference numeral 10. As shown in the preferred embodiment, the firearm sights aligner device 10 is mounted from the muzzle end of military rifle 12. The firearm sights aligner device 10 of the present invention is not limited to use with military firearms or for that matter rifles. Nor is the firearm sights aligner device 10 limited to use with open or aperture iron sights and it can also be used with night vision and day telescopic sighting devices.

Figure 2:
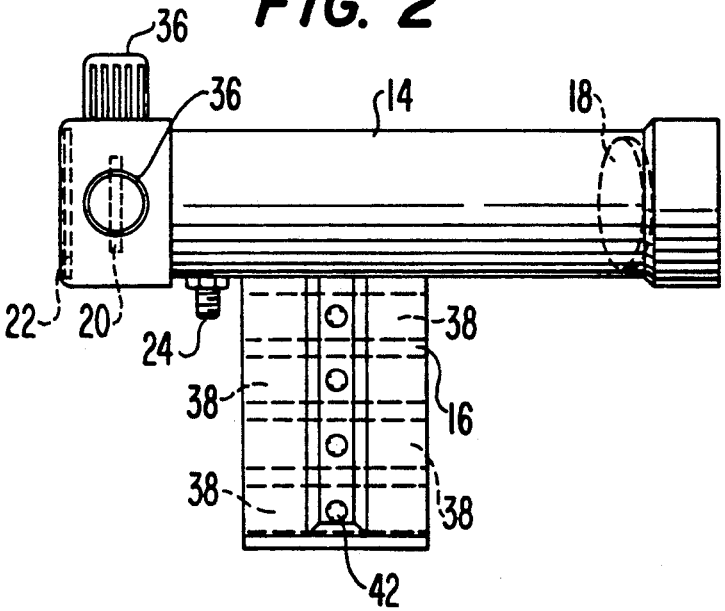
FIG. 2 is a plan view of the collimator assembly of the present invention showing internal components in phantom.

The firearm sights aligner device 10 includes a collimator assembly 14 and support block 16. Shown in phantom in FIG. 2 are collimator components, i.e. collimating lens 18, sighting grid 20 and defuser 22. The defuser 22 provides for back lighting of the sighting grid 20. With the collimating lens 18 positioned at the focal distance for the sighting grid 20 an infinitely distant image of the sighting grid 20 is presented along the firearm sighting plane. Also shown in FIG. 2. is a nitrogen purge valve 24 for filing the collimator assembly 15 with dry nitrogen to prevent fogging.

Figure 3:
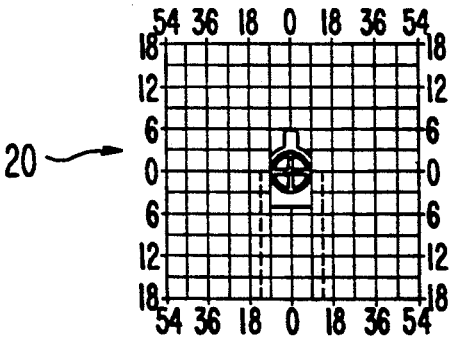
FIG. 3 is a plan view of a sighting grid for the present invention.
Figure 4:
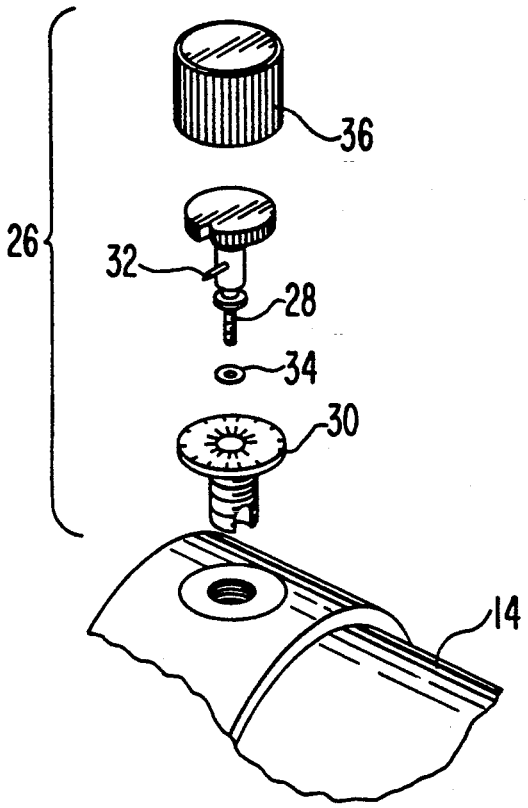
FIG. 4 is an exploded view of an adjusting screw mechanism for the present invention.

A preferred form of sighting grid 20 is shown in FIG. 3. The sighting grid 20 can be etched on a glass plate (not shown) and mounted in a holder 21, (see, FIG. 7) in the collimator assembly 14. An adjusting screw mechanism 26 is shown in exploded view in FIG. 4. Both azimuth and elevation adjusting screw mechanisms 26 are provided for moving the sighting grid 20 in translation. However, neither the azimuth or elevation adjusting screw mechanisms 26 are arranged to be in direct contact with the plate on which the sighting grid 20 is etched. Nor are coil springs used to load the sighting grid 20 to follow movement of the adjusting screw mechanisms 26. Instead known four bar torsion systems, generally designated by reference numeral 23 (See, FIG. 7), are used in combination with the adjusting screw mechanisms 26 to provide linear translations of the sighting grid 20 in azimuth and elevation perpendicular to the optic axis of the collimator assembly 14. The four bar torsion system 23 includes a movable cone 25 and torsion bars 27.

Critically important to the present invention are the adjusting screw mechanisms 26. They must in combination with four bar torsion systems move the sighting grid 20 through its full extension of translation in one 360 degree revolution of the adjusting screw mechanism 26. To accomplish this full translation multi-start threaded screws 28 are used for both the azimuth and elevation adjusting screw mechanisms 26. These multi-start threaded screws 28 accomplish the necessary movement in one 360 degree revolution or less. In combination with each multi-start threaded screw 28 is a graduated ring 30 that with a pointer 32 on the multi-start threaded screw 28 permits recording of angular position of the multi-start threaded screw 28 and therefore linear position of the sighting grid 20. The purpose of the combination of the pointer 32 and the graduated ring 30 can also be accomplished by, for example, a vernier caliber mechanism or other known systems for determining angular or linear motion accurately. An O-ring 34 is positioned on the multi-start threaded screw 28 against the housing of the graduated ring 30 to prevent gases from leaking out and also preventing moisture for entering the collimator assembly 14. Finally dust cap 36 is provided for protecting each adjusting screw mechanism 26.

Figure 5:
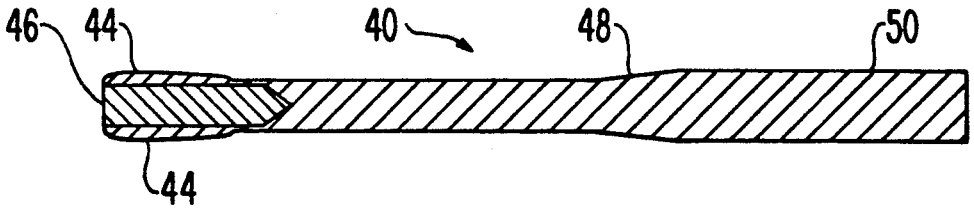
FIG. 5 is a sectional side view of an expanding bore adapter for the present invention.
Figure 6:
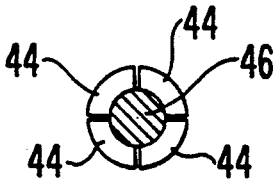
FIG. 6 is an end view of the expanding bore adapter shown in FIG. 5.

The support block 16 attached to the collimator assembly 14 includes at least one longitudinal hole 38 that is parallel to the optic axis of the collimator assembly 14. Four such longitudinal holes are shown in FIG. 2. Depending on the elevation of the sighting plane above the axis of the bore on a firearm an appropriate diameter expanding bore adapter 40 (See FIG. 5.) is positioned in the correct longitudinal hole 38 and held in place with a set screw 42. The expanding bore adapter 40 incorporates expanding fingers 44 (See, FIG. 6.), centroid loaded elastic compound 46 and a muzzle seat 48. Insertion of the expanding bore adapter 40 into the muzzle of a firearm pushes the expanding fingers 44 inward thereby compressing the elastic compound 46 and locating the expanding bore adapter 40 at the enterline of the barrel bore. The elastic compound 46 is impervious to barrel bore contaminants. The shank 50 which is inserted in the longitudinal hole 38 is bevelled on one side (not shown) for being contacted by the set screw 42 to insure circular location repeatability.

The sights aligner device 10 of the present invention can be used in at least two operating scenarios. These will be illustrated by military examples, but these examples are also applicable to civilian use.

Firearms initially delivered to a military unit by a manufacturer do not have their aiming sights precisely set or calibrated. It is therefore necessary, when the firearms are issued to a soldier, to calibrate or zero the sights on the firearm to insure alignment. This is done on a firing range using live ammunition.

First, a qualified marksman zeros a firearm to be identified as a master on the firing range using conventional methods. Then the sights aligner device 10 is mounted from the firearm by inserting the proper caliber expanding bore adapter 40, which is affixed in the correct longitudinal hole 38, into the muzzle of the previously zeroed master firearm. The collimator assembly 14 is located upright to permit viewing of the sighting grid 20 with the master firearm sights. The sights aligner device 10 is now ready for calibration to the master firearm.

While the marksman sights the firearm, the armorer operates the adjusting screw mechanisms 26 on the sights aligner device 10 for azimuth and elevation per instructions of the marksman to align the sighting grid 20 aiming point to the sights of the master firearm which has been previously zeroed. The sights aligner device 10 is now calibrated.

To align sights on other firearms of the same type, i.e. caliber and action type, the marksman goes to each soldier on the firing line, inserts the calibrated sights aligner device 10 in to the muzzle of the firearm, and instructs the soldier to move the azimuth and elevation adjustments on the sights of his firearm to obtain a proper sight picture with the sighting grid 20. After all firearms of the same type are zeroed, the soldier will normally shoot a few confirming rounds to insure the firearm sights are accurately set to account for individual comfort.

Since there are normally a number of different types of firearms in each operating military unit, it is necessary to repeat the above procedure for each of the different types of firearms. This means the initial setting of the sighting grid 20 in the sights aligner device 10 must be changed by the qualified marksman to correspond to each new type of firearm as, for example, the height of the sights above the barrel are different for various weapons.

A problem now develops in that azimuth and elevation calibration mechanisms on the presently known sight aligners do not permit the marksman to repeatedly readjust the position of the sighting grid in the sights aligner to its' previously determined correct position for that particular type of weapon. This deficiency requires the initially zeroed master firearm be set aside and not disturbed as the only way to re-calibrate for that type of firearm. This procedure of re-calibrating is not only time consuming but it also requires a sample master of each type of firearm being set aside and not operationally used. Quite often four or more types of firearms are used in a typical military operating unit. In this case, four firearms would be isolated and set aside as masters not to be disturbed.

Figures 7, 8:
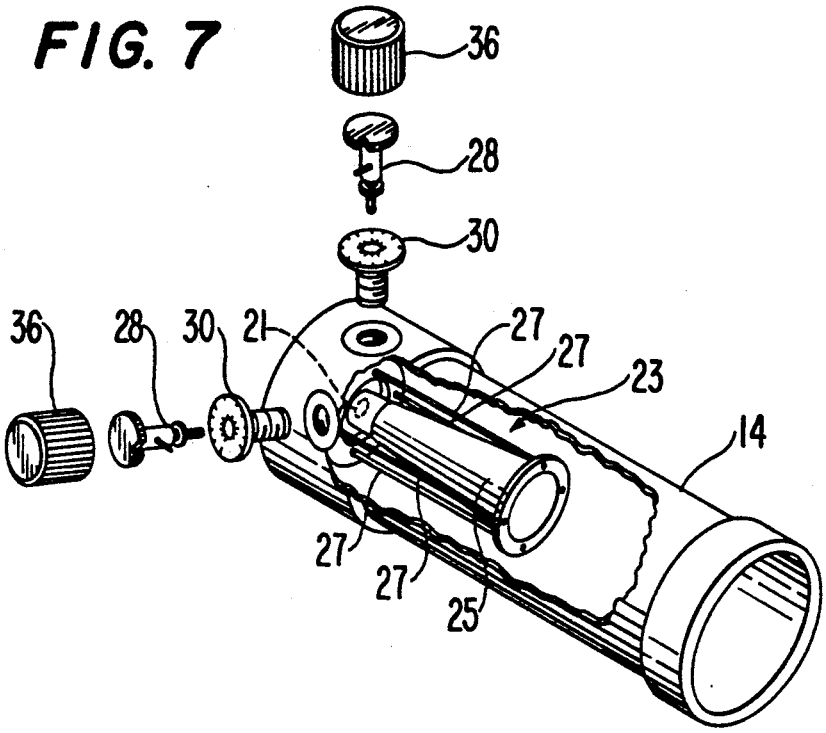
FIG. 7 is a perspective view of the collimator assembly of the present invention in partial sectional view to show a four bar torsion system for mounting the sighting grid; and, FIG. 8 shows a format for a recording card to be used with the sights aligner device of the present invention.

To facilitate sight calibration on different firearm types for military unit a recording card 31 of a format as shown in FIG. 8 can be used. For example, when an M16A2, 5.56 mm rifle is zeroed in and the elevation and azimuth of the sighting grid 20 of the sights aligner device 10 of the present invention are adjusted to be aligned with the M16A2 sights the elevation and azimuth pointer 32 positions with respect to the graduated rings 30 are written on the recording card 31 in the appropriate columns at the M16A2 row. Also provided at that row on the recording card 31 is identification of the longitudinal hole 38 to be used for M16A2 rifles. Now whenever M16A2 rifle sights need to be calibrated the written settings for the sights aligner device 10 can be referred to and proper adjustments can be made without having to fire ammunition or calibrate from a master weapon. The same procedures for using the recording card 31 can be followed all the way through the M2, 50 caliber machine gun.

The second operating scenario likewise shows up the deficiency of not being able to re-calibrate the sighting grid 20 to its' previously determined correct position for a particular type of firearm. In this case, it is often standard procedure at the end of the day, for each soldier to store his firearm in a central armory. As he subsequently is re-issued his firearms, if time permits, each soldier will re-zero his particular firearm to insure that his sights have not been disturbed and his firearm is correctly zeroed. Again, since the qualified marksman cannot return the sighting grid 20, in azimuth and elevation, to its predetermined correct setting for a particular type of firearm, he must again, using the master of each type of firearm, re-calibrate for each different type of firearm before the other similar firearms can be zeroed. Again, this requires the master of each firearm type being set aside and isolated for this resetting process.

For a civilian marksman it is not feasible to maintain isolated master firearms. However, using the sights aligner device 10 of the present invention the civilian marksman can recalibrate the sights aligner device 10 for each firearm in his collection.

The above discussion and related illustrations of the present invention are directed primarily to a preferred embodiment and practices of the invention. However, it is believed that numerous changes and modifications in the actual implementation of the concepts described herein will be apparent to those skilled in the art, and it is contemplated that such changes and modifications may be made without departing from the scope of the invention as defined by the following claims.

We claim:

1. A firearm sights aligning device comprising:

a collimating means with sighting grid means, first adjusting screw means for changing azimuth position in said collimator means of said sighting grid means, and second adjusting screw means for changing elevation position in said collimator means of said sighting grid means;

first graduation means for determining rotational position of said first adjusting screw means, and second graduation means for determining rotational position of said second adjusting screw means; and, said first adjusting screw means in one 360 degree rotation causing said sighting grid means to be moved in linear translation across all azimuth positions for said collimator means, and said second adjusting screw means in one 360 degree rotation causing said sighting grid means to be moved in linear translation across all elevation positions for said collimator means; wherein said first and said second adjusting screw means include multi-start threaded screws.

2. A firearm sights aligning device as described in claim 1 wherein said collimator means includes defuser means to back light said sighting grid means.

3. A firearm sights aligning device as described in claim 1 wherein said collimator means includes a gas purge means for filling gas into said collimator means.

4. A firearm sights aligning device as described in claim 1 wherein a support block means is attached to said collimator means, said support block means having at least one hole having a longitudinal axis parallel to the longitudinal axis of said collimator means.

5. A firearm sights aligning device as described in claim 4 wherein an expanding adapter means is positioned in one of said at least one holes having a longitudinal axis parallel to the longitudinal axis of said collimator means in said support block means, said expanding bore adapter means having at one end elastic compressible compound means for increasing the outside diameter of said expanding bore adapter means.

* * * * *